US010113457B2

(12) United States Patent
Oh

(10) Patent No.: US 10,113,457 B2
(45) Date of Patent: Oct. 30, 2018

(54) CAMSHAFT MODULE

(71) Applicant: HYUNDAI MOTOR COMPANY, Seoul (KR)

(72) Inventor: Mee Sun Oh, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 94 days.

(21) Appl. No.: 15/376,277

(22) Filed: Dec. 12, 2016

(65) Prior Publication Data

US 2018/0106169 A1 Apr. 19, 2018

(30) Foreign Application Priority Data

Oct. 13, 2016 (KR) ..... 10-2016-0132556

(51) Int. Cl.

| | |
|---|---|
| ***F01M 9/10*** | (2006.01) |
| ***F02F 7/00*** | (2006.01) |
| ***F02F 11/00*** | (2006.01) |
| ***F01L 1/053*** | (2006.01) |
| ***F01L 1/18*** | (2006.01) |

(52) U.S. Cl.

CPC ..... *F01M 9/101* (2013.01); *F01L 1/053* (2013.01); *F01L 1/185* (2013.01); *F02F 7/006* (2013.01); *F02F 11/002* (2013.01); *F01L 2001/0537* (2013.01); *F01L 2103/00* (2013.01); *F01L 2105/00* (2013.01); *F02B 2275/18* (2013.01)

(58) Field of Classification Search

CPC ..... F02F 7/006; F02F 11/002; F02B 2275/18; F01L 1/053; F01L 2001/0537; F01M 9/101

USPC ..... 123/193.5, 193.3; 277/313, 591, 628

See application file for complete search history.

(56) References Cited

U.S. PATENT DOCUMENTS

| | | | | |
|---|---|---|---|---|
| 5,375,569 | A * | 12/1994 | Santella | B29C 45/1676 123/195 C |
| 8,156,909 | B2 | 4/2012 | Seo | |
| 9,638,069 | B2 | 5/2017 | Yoon et al. | |
| 2004/0182354 | A1* | 9/2004 | Ueno | F02F 1/38 123/193.5 |
| 2006/0055123 | A1* | 3/2006 | Angot | F02F 7/006 277/628 |
| 2010/0139595 | A1 | 6/2010 | Seo | |
| 2016/0108765 | A1 | 4/2016 | Yoon et al. | |

FOREIGN PATENT DOCUMENTS

| | | |
|---|---|---|
| JP | 3714465 | 11/2005 |
| JP | 2007077962 | 3/2007 |
| KR | 20100064992 | 6/2010 |
| KR | 101611085 B1 | 4/2016 |

* cited by examiner

*Primary Examiner* — Mark Laurenzi
*Assistant Examiner* — Wesley Harris
(74) *Attorney, Agent, or Firm* — Lempia Summerfield Katz LLC

(57) ABSTRACT

A camshaft module includes: a head cover in which a camshaft is seated; a cylinder head with an upper portion coupled to a lower portion of the head cover, and in which a plurality of cam followers, operated according to a rotation of the camshaft, are formed on the upper portion; and a gasket sealing between the head cover and the cylinder head. The gasket has a plurality of cam holes formed therein. The cam followers penetrate through the cam holes. The gasket has supporting parts formed to protrude so as to prevent a falling of the cam followers around the cam holes.

8 Claims, 4 Drawing Sheets

CAMSHAFT MODULE

CROSS REFERENCE TO RELATED APPLICATION

This application claims priority to and the benefit of Korean Patent Application No. 10-2016-0132556 filed on Oct. 13, 2016, entitled "Camshaft Module", which is hereby incorporated by reference in its entirety into this application.

BACKGROUND

1. Technical Field

The present disclosure relates to a camshaft for an engine, and more particularly to a camshaft module having a simple structure.

2. Description of the Related Art

A cam carrier module for a vehicle according to the related art is configured to include a cam carrier coupled to a cylinder head. Such a cam carrier module also has an injector formed to penetrate through the cam carrier and the cylinder head and a sealing means formed in a shape surrounding the injector between the cam carrier and the cylinder head to create a seal.

Further, the cam carrier module for a vehicle has been provided that improves sealing performance by improving a seam structure between the cam carrier and the cylinder head.

In addition, a camshaft was made simpler to assemble by simplifying a structure of the cam carrier. Improvement in fuel efficiency was also intended by improving, ie., reducing friction of a driving system by applying a rolling bearing.

The matters described as the related art have been provided only for assisting in understanding the background of the present disclosure and should not be considered as corresponding to the related art known to those having ordinary skill in the art.

SUMMARY

An object of the present disclosure is to provide a camshaft module that prevent a cam follower from falling when operated according to a rotation of a camshaft.

According to an embodiment of the present disclosure, a camshaft module is provided that includes a head cover in which a camshaft is seated. The camshaft module has a cylinder head with an upper portion that is coupled to a lower portion of the head cover. A plurality of cam followers, which are operated according to a rotation of the camshaft, are formed on the upper portion of the cylinder head. A gasket provides a seal between the head cover and the cylinder head and has a plurality of cam holes formed therein. The cam followers penetrate through the cam holes. The gasket also has supporting parts formed to protrude so as to prevent a falling of the cam followers around the cam holes.

A journal part may be formed in the head cover. The journal part may be a space into which the camshaft is inserted from a lower side of the head cover. The camshaft module may further include a cam cap assembled to a lower side of the head cover so as to be assembled in a state in which the camshaft is seated in the journal part.

The gasket may include an edge part formed along an edge between the head cover and the cylinder head. The gasket may also have a connection part that seals between the head cover and the cylinder head inside the edge part. The connection part may be provided to form the cam holes and injector holes through which injectors may penetrate. The edge part and the connection part may be integrally formed.

The gasket may have the supporting parts formed at opposite sides of the cam holes or on only at one side of the cam holes.

A bolt hole may be formed in the edge part. The head cover, the gasket, and the cylinder head may be coupled to each other by a bolt penetrating through the bolt hole.

DESCRIPTION OF THE EMBODIMENTS

Hereinafter, a camshaft module according to embodiments of the present disclosure will be described with reference to the accompanying drawings.

Figure 1:
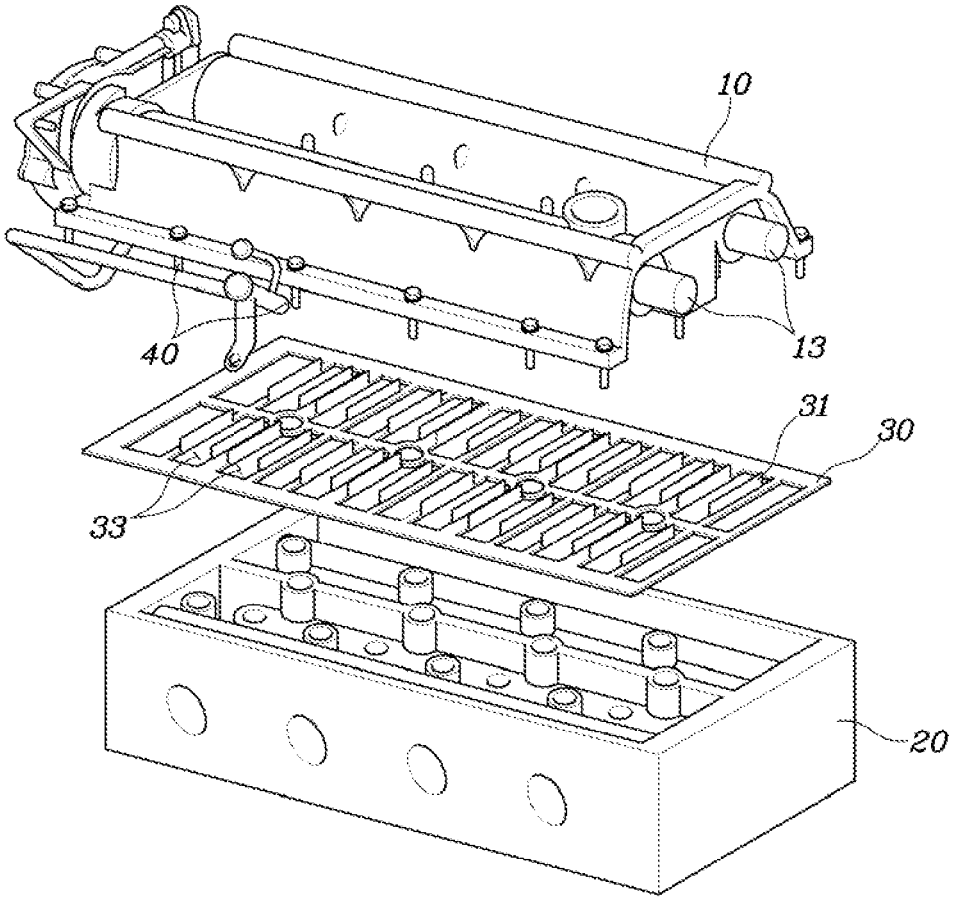
FIG. 1 is an assembly view illustrating a camshaft module according to an embodiment of the present disclosure.
Figure 2:
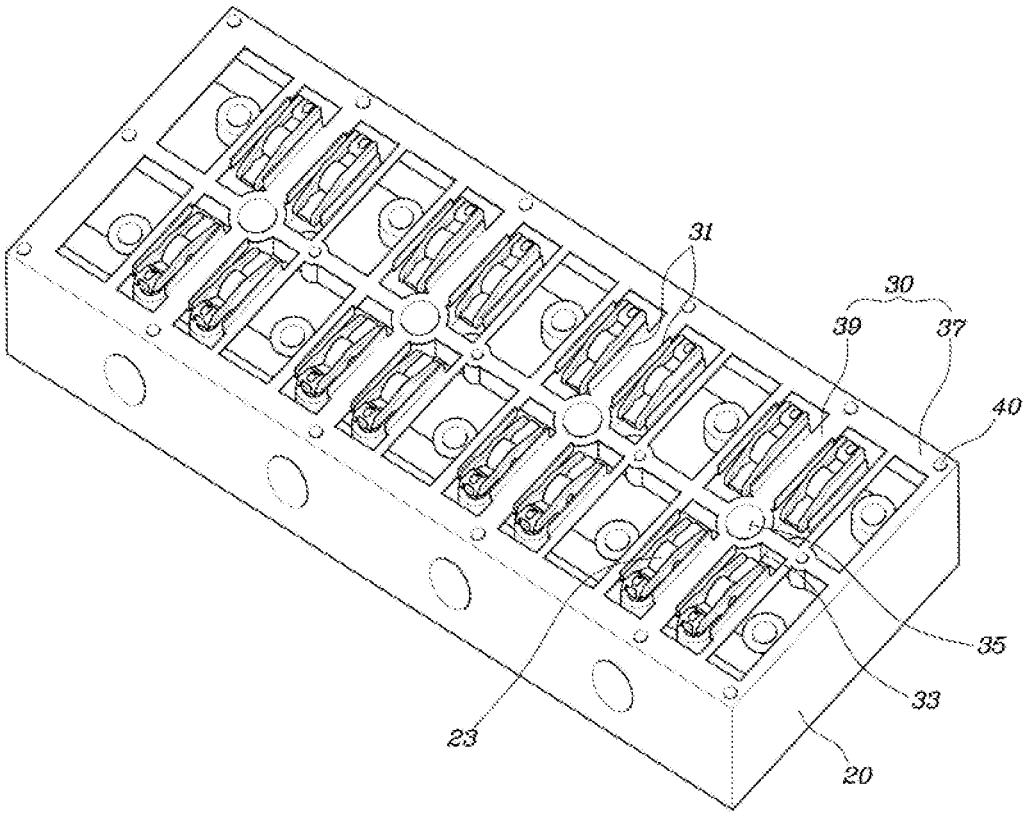
FIG. 2 is a perspective view illustrating an assembled state of a cylinder head and a gasket according to an embodiment of the present disclosure.
Figure 3:
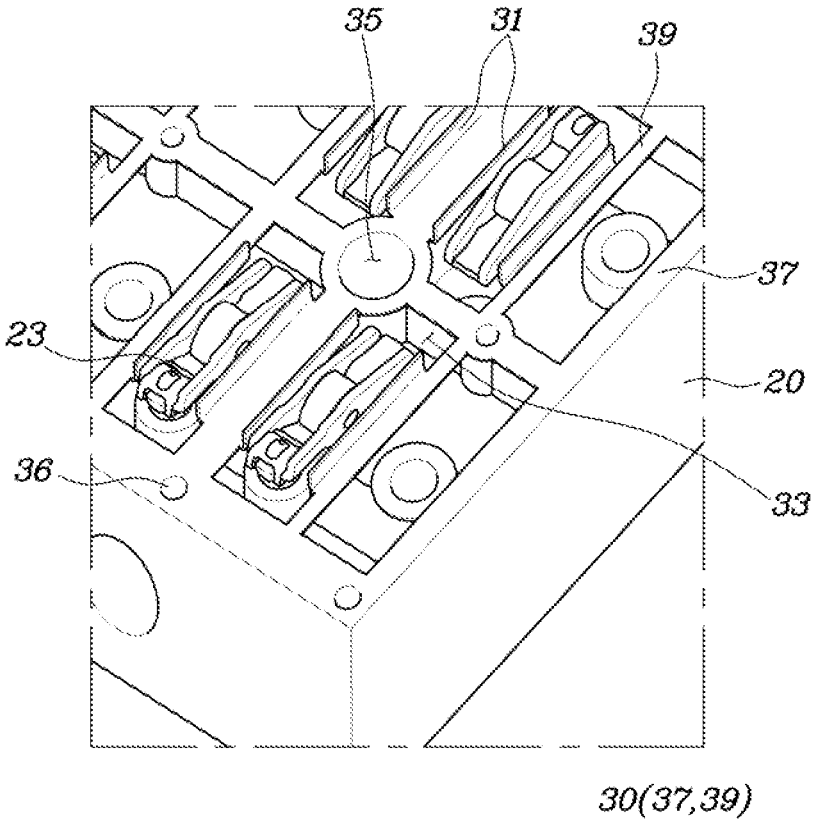
FIG. 3 is a detailed view illustrating the assembled state of a cylinder head and a gasket according to an embodiment of the present disclosure.

FIG. 1 is an assembly view illustrating a camshaft module according to an embodiment of the present disclosure. FIG. 2 is a perspective view illustrating an assembled state of a cylinder head and a gasket according to an embodiment of the present disclosure. FIG. 3 is a detailed view illustrating the assembled state of a cylinder head and a gasket according to an embodiment of the present disclosure. Referring to FIGS. 1-3, the camshaft module may include a head cover 10 in which a camshaft 13 is seated. The camshaft module may include a cylinder head 20 with an upper portion that is coupled to a lower portion of the head cover 10. A plurality of cam followers 23, operated according to a rotation of the camshaft 13, are formed on the upper portion of the cylinder head. The camshaft module may also include a gasket sealing between the head cover 10 and the cylinder head 20. The gasket may have a plurality of cam holes 33 formed therein, whereby the cam followers 23 penetrate through the cam holes 33. The gasket may also have supporting parts 31 formed to protrude so as to prevent the cam followers 23 from falling around the cam holes 33.

The plurality of cam followers 23 are each connected to an intake value or an exhaust value included in the cylinder head 20. and the plurality of cam followers 23 are provided to be in contact with cams of the camshaft 13 according to the rotation of the camshaft 13 to control an open and close of the connected intake valve and exhaust valve.

In particular, according to the present disclosure, the camshaft module is configured having the head cover 10, the gasket 30, and the cylinder head 20, which are coupled in this order from an upper side. The camshaft module is a configuration to which a separate cam carrier is not employed because the camshaft 13 is directly assembled in the head cover 10. According to the above-mentioned configuration, the number of parts used to configure the camshaft module may be reduced, thereby making it possible to reduce production cost and to simplify a process of manufacturing the camshaft module.

However, in the case in which the head cover 10 is directly coupled to the upper portion of the cylinder head 20 as described above, since a separate window is not formed in the head cover 10, it is difficult to detect a phenomenon in which the cam followers 23 formed on the upper portion of the cylinder head 20 have fallen during assembly or operation thereof.

Therefore, according to the present disclosure, the supporting parts 31 are originally formed on the gasket 30 and protrude therearound. The supporting parts 31 thereby prevent the cam followers 23 from falling, thereby making it possible to improve marketability of the camshaft module.

Although FIGS. 1-3 illustrate an embodiment in which the support parts 31 are formed to upwardly protrude from the gasket 30, the supporting parts 31 may also be formed to downwardly protrude from the gasket 30 according to a designer or a particular engine application or layout. The specific direction in which the supporting parts 31 are formed to protrude should not be limited.

In this embodiment, since the gasket 30 is formed of a metal material, the supporting parts 31 are formed of the same metal material and are formed around the cam holes 33. This makes it possible to effectively prevent the falling phenomenon of the cam followers 23. In addition, the supporting parts 31 may be manufactured together at the time of a press process performed to manufacture the gasket 30. Therefore, a process of manufacturing the camshaft module may be simplified.

Figure 4:
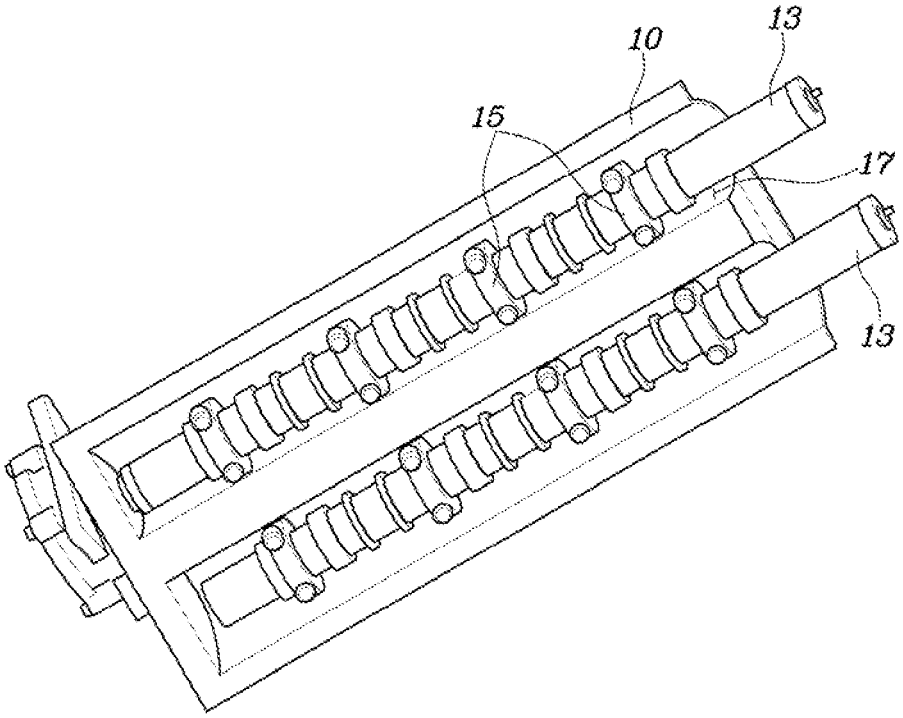
FIG. 4 is a perspective view illustrating a head cover according to an embodiment of the present disclosure and viewed from a lower side.

FIG. 4 is a perspective view illustrating a head cover according to an embodiment of the present disclosure and viewed from a lower side of the head cover. Referring to FIG. 4, according to the present disclosure, a journal part 17 is formed in the head cover 10. The journal part 17 is a space into which the camshaft 13 is inserted from a lower side of the head cover 10. The camshaft module further includes a cam cap 15 that is assembled to a lower side of the head cover 10 so as to be assembled in a state in which the camshaft 13 is seated in the journal part 17.

In other words, according to the present disclosure, since the cam shaft 13 is assembled so as to be seated in the head cover 10 without employing a separate cam carrier, the journal part 17, which is a space having a semicircular shape in which the camshaft 13 is seated in the head cover 10, is formed in a lengthwise direction.

Further, the cam caps 15 also have a semicircular shape and are assembled to the lower side of the head cover 10 so that the cam shaft 13 is fixed to the journal part 17 in a state in which the cam shaft 13 is seated in the journal part 17. Therefore, a module in which the camshaft 13 is assembled in the head cover 10 may be implemented.

Further, again referring to FIGS. 1-3, according to the present disclosure, the gasket 30 may include an edge part 37 that is formed along an edge between the head cover 10 and the cylinder head 20. and the Gasket 30 may also include a connection part 39 sealing between the head cover 10 and the cylinder head 20 inside the edge part 37. The connection part 39 may be provided to form the cam holes 33 and injector holes 35 through which the injectors penetrate. The edge part 37 and the connection part 39 may also be integrally formed.

In other words, a single gasket 30 is provided between the head cover 10 and the cylinder head 20. Specifically, the gasket integrally forms the edge part 37, which seals edge sides of the head cover 10 and the cylinder head 20, and the connection part 39, which seals around the cam followers 23 and the injectors. The integral gasket construction thereby makes it possible to reduce the number of parts required or used to perform a coupling between the head cover 10 and the cylinder head 20. to the gasket construction also reduces the need for clipping occurring at the time of a gasket press process as compared to a case in which a plurality of gaskets are provided. As a result, production cost and weight may be reduced.

In this embodiment, holes are formed in the cylinder head so that the injectors are inserted into the holes along an intermediate line. The injector holes 35 of the gasket 30 are provided at corresponding positions. This makes it possible to prevent a foreign material from being introduced around the injectors while allowing the injectors to penetrate through the cylinder head 20 to be extended to a cylinder.

Further, the gasket 30 may have the supporting parts 31 formed adjacent opposite sides of the cam holes 33 or only adjacent one side of the cam holes 33.

The cam followers 23 control an open and close of valves in an engine by operating in the same direction as a rotation direction of the camshaft 13. The cam followers 23, however, are not moved in a shaft direction of the camshaft 13. However, in the process of assembling the head cover 10 or the process of operating the cam followers 23, a situation in which the cam followers 23 have fallen in a length direction has occurred.

Therefore, according to the present disclosure, the supporting parts 31 are formed on the gasket 30. More specifically, the supporting parts 31 are formed at or along opposite sides of the cam holes 33 or at or along one of the sides of the cam holes 33, such that the positions at which the supporting parts 31 are formed are minimized while preventing the cam followers 23 from falling in the length direction, i.e., moving, twisting, or falling in a direction relative to the axis or axial direction of the camshaft. This makes it possible to further simplify the process of manufacturing the camshaft module.

Further, according to the present disclosure, a bolt hole 36 is formed in the edge part 37. The head cover 10, the gasket 30, and the cylinder head 20 may be coupled to each other by a bolt 40 that penetrates through the bolt hole 36.

According to the camshaft module having the structure as described above, the module configuration in which the camshaft and head cover are integrally formed may not confirm the falling of the cam follower. However, it is possible to prevent the falling of a cam follower by the configuration of the supporting parts on the gasket, thereby making it possible to increase marketability of the camshaft module. The supporting parts essentially capture and hold the cam followers in place so the cam followers do not fall, rotate, twist, or otherwise move Although the present disclosure is shown and described with reference to the specific embodiments, it will be apparent to those having ordinary skill in the art that modifications and variations can be made without departing from the spirit and scope of the disclosure as defined by the appended claims.

What is claimed is:

1. A camshaft module comprising:

a head cover in which a camshaft is seated;

a cylinder head with an upper portion coupled to a lower portion of the head cover, and with a plurality of cam followers, operated according to a rotation of the camshaft, formed on the upper portion; and a gasket between the head cover and the cylinder head, the gasket having a plurality of cam holes formed therein, the cam followers penetrating through the plurality of cam holes, and having supporting parts formed to protrude so as to prevent a falling of the cam followers around the plurality of cam holes.

2. The camshaft module of claim 1, further comprising:

a journal part formed in the head cover, wherein the journal part is a space into which the camshaft is inserted from a lower side of the head cover; and a cam cap assembled to the lower side of the head cover so as to be assembled in a state in which the camshaft is seated in the journal part.

3. The camshaft module of claim 1, wherein the gasket includes an edge part formed along an edge between the head cover and the cylinder head, and includes a connection part between the head cover and the cylinder head and inward of the edge part, the connection part provided to form the plurality of cam holes and to form injector holes through which injectors penetrate.

4. The camshaft module of claim 3, wherein the edge part and the connection part are integrally formed as a part of the gasket.

5. The camshaft module of claim 4, further comprising:

a bolt hole formed in the edge part, wherein the head cover, the gasket, and the cylinder head are coupled to each other by a bolt penetrating through the bolt hole.

6. The camshaft module of claim 3, further comprising:

a bolt hole formed in the edge part, wherein the head cover, the gasket, and the cylinder head are coupled to each other by a bolt penetrating through the bolt hole.

7. The camshaft module of claim 1, wherein the supporting parts are formed in the gasket on at least one side of the plurality of cam holes.

8. The camshaft module of claim 7, wherein the supporting parts are formed in the gasket on opposite sides of the plurality of cam holes.

* * * * *